US007086960B2

(12) United States Patent
Huang et al.

(10) Patent No.: US 7,086,960 B2
(45) Date of Patent: Aug. 8, 2006

(54) GOLF CLUB HEAD WITH A STRUCTURE FOR FRICTION WELDING AND MANUFACTURING METHOD THEREFOR

(75) Inventors: Chun-Yung Huang, Kaohsiung Hsien (TW); Chan-Tung Chen, Kaohsiung (TW)

(73) Assignee: Nelson Precision Casting Co., Ltd., Kaohsiung (TW)

( * ) Notice: Subject to any disclaimer, the term of this patent is extended or adjusted under 35 U.S.C. 154(b) by 0 days.

(21) Appl. No.: 10/755,319

(22) Filed: Jan. 13, 2004

(65) Prior Publication Data

US 2005/0124432 A1 Jun. 9, 2005

(30) Foreign Application Priority Data

Dec. 8, 2003 (TW) ..... 92134607 A

(51) Int. Cl.
*A63B 53/04* (2006.01)
*B23K 20/12* (2006.01)

(52) U.S. Cl. ..... 473/305; 473/349; 228/112.1; 228/114.5

(58) Field of Classification Search ..... 473/305, 473/349, 324; 228/114.5, 112.1
See application file for complete search history.

(56) References Cited

U.S. PATENT DOCUMENTS

| | | | | | |
|---|---|---|---|---|---|
| 4,621,760 | A | * | 11/1986 | King et al. | 228/114.5 |
| 5,669,825 | A | * | 9/1997 | Shira | 473/324 |
| 5,769,307 | A | * | 6/1998 | Takeda | 228/112.1 |
| 5,885,170 | A | | 3/1999 | Takeda | |
| 2004/0177812 | A1 | * | 9/2004 | Goto et al. | 118/725 |

FOREIGN PATENT DOCUMENTS

| | | | |
|---|---|---|---|
| JP | 54-112760 | * | 9/1979 |
| JP | 2003-25075 | * | 1/2003 |

* cited by examiner

*Primary Examiner*—Stephen Blau
(74) *Attorney, Agent, or Firm*—Birch, Stewart, Kolasch & Birch, LLP

(57) ABSTRACT

A golf club head includes a first portion forming a part of a head body of the golf club head and a second portion forming another part of the head body. The first portion is made of a first metal material and includes an abutting portion. The second portion is made of a second metal material and includes an abutting portion. At least one inclined or arcuate surface for friction welding is formed on the abutting portion of the first portion. The inclined or arcuate surface for friction welding provides the abutting portion of the first portion and the abutting portion of the second portion with improved bonding strength and increased joining area when joining the first portion and the second portion together by welding friction to form a golf club head product. A method for manufacturing a golf club head by friction welding is also disclosed.

4 Claims, 15 Drawing Sheets

GOLF CLUB HEAD WITH A STRUCTURE FOR FRICTION WELDING AND MANUFACTURING METHOD THEREFOR

This Non-provisional application claims priority under 35 U.S.C. §119(a) on Patent Application No(s). 92134607 filed in Taiwan on Dec. 8, 2003, the entire contents of which are hereby incorporated by reference.

BACKGROUND OF THE INVENTION

1. Field of the Invention

The present invention relates to a golf club head. In particular, the present invention relates to a golf club head with a structure for friction welding. The present invention also relates to a friction welding method for manufacturing a golf head.

2. Description of Related Art

A typical golf club head and a production method therefore are disclosed in, e.g., U.S. Pat. Nos. 5,769,307 and 5,885,170. As illustrated in FIGS. 1 and 2 of the drawings, which respectively correspond to FIGS. 1 and 2 of U.S. Pat. Nos. 5,769,307 and 5,885,170, a typical golf club includes a head body 10, a hose 20, and a shaft 30. The head body 10 is made of a first metal material such as stainless steel and includes a striking plate 11 on a front side thereof, with a heel 12 being formed on a side of the striking plate 11, and with an extension 13 extending upward from the heel 12 and having a flat abutting portion 14. Another flat abutting portion 22 is formed at a lower part of the hosel 20 that is formed of a second metal material such as titanium alloy. The hosel 20 includes an engaging hole 21 in an upper part thereof for engaging with a lower end of a shaft 30.

A force F is applied to the head body 10 and the hosel 20 to make the flat abutting portion 14 abuts against the flat abutting portion 22. Then, the flat abutting portion 14 (or the flat abutting portion 22) is turned relative to the flat abutting portion 22 (or the flat abutting portion 14). With the friction heat, the head body 10 can be joined to the hosel 20.

Although the friction welding simplifies the manufacturing process and cuts the manufacturing cost in comparison to ordinary welding or brazing, several problems exist. Firstly, as illustrated in FIGS. 3 and 4, an intermetallic layer (or hardening layer) is formed between the flat abutting portion 14 made of the first metal material (such as stainless steel, see the left portion of FIG. 4) and the flat abutting portion 22 made of the second metal material (such as titanium alloy, see the right portion of FIG. 4). Thus, the flat abutting portion 14 is connected to the flat abutting portion 22. Since the metal material (e.g., stainless steel) of the flat abutting portion 14 and the metal material (e.g., titanium alloy) of the flat abutting portion 22 have poor compatibility in welding, the metallurgic structure of the intermetallic layer is detrimental to improvement of the bonding strength, resulting in a fragile structure or reducing the resilient deforming capability. As a result, the joining area between the head body 10 and the hosel 20 may break when proceeding with adjusting of inclination angle A of the hosel 20 of the golf club head product or when striking a golf ball. The good product ratio is reduced, and the life of the club head is shortened. Results of cannon shot tests showed that the head body 10 and the hosel 20 were apt to crack or break after being shot not more than 1000 times (a golf ball with a standard weight hit the striking plate 11 of the head body 10 at a velocity of 50 m/sec). The same problem exists when using friction welding to bond two portions of the club head that are made of different metals having insufficient welding compatibility.

OBJECTS OF THE INVENTION

An object of the present invention is to provide a golf club head that has at least one inclined or arcuate surface for friction welding on a portion of the golf club head, allowing the portion of the golf club head to be joined to another portion of the golf club head by friction welding, avoiding generation of the intermetallic layer, increasing the joining area, providing improved joining reliability, improving good product ratio, and prolonging the life of the golf club head product.

Another object of the present invention is to provide at least one inclined or arcuate surface for friction welding on one of a head body and a hosel of a golf club head, thereby joining the head body and the hosel by friction welding, providing improved joining reliability for the hosel, and increasing adjusting range of the inclination angle of the hosel.

A further object of the present invention is to provide at least one inclined or arcuate surface for friction welding on one of a head body and a weight member of a golf club head, thereby joining the head body and the weight member by friction welding, providing improved boding strength for the weight member, and providing improved joining reliability for the weight member.

Still another object of the present invention is to provide a method for manufacturing a golf club head by friction welding.

SUMMARY OF THE INVENTION

In accordance with an aspect of the present invention, a golf club head includes a first portion forming a part of a head body of the golf club head and a second portion forming another part of the head body of the golf club head. The first portion is made of a first metal material and includes an abutting portion. The second portion is made of a second metal material and includes an abutting portion. At least one inclined or arcuate surface for friction welding is formed on the abutting portion of the first portion. The inclined or arcuate surface for friction welding provides the abutting portion of the first portion and the abutting portion of the second portion with improved bonding strength and increased joining area when joining the first portion and the second portion together by welding friction to form a golf club head product.

The inclined or arcuate surface for friction welding increases the abutting pressure, increases the temperature for friction welding, provides improved bonding by friction welding, avoids generation of the intermetallic layer, increases the joining area, improves the bonding strength, and improves the bonding reliability.

In accordance with another aspect of the present invention, a method for manufacturing a golf club head by friction welding comprises:

forming one of at least one inclined surface for friction welding and at least one arcuate surface for friction welding on an abutting portion of a first portion of a head body of the golf club head;

abutting the abutting portion of the first portion against an abutting portion of a second portion of the head body of the golf club head; and rotating one of the abutting portion of the first portion and the abutting portion of the second portion relative to the other of the abutting portion of the first portion and the abutting portion of the second portion about an axis to proceed with friction welding, thereby forming a joining area; and surface finishing the joining area of the abutting portion of the first portion and the abutting portion of the second portion.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
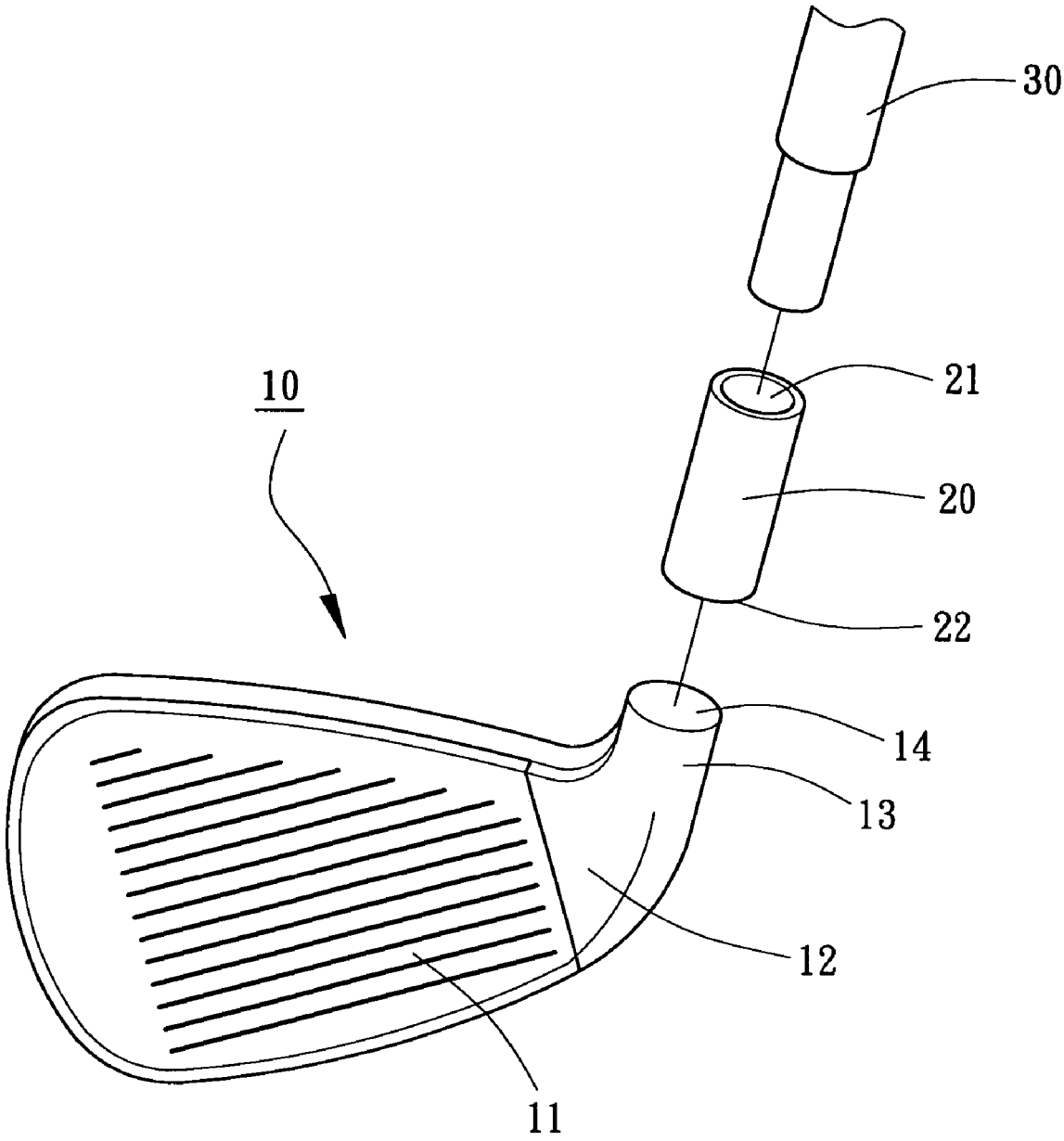
FIG. 1 PRIOR ART
FIG. 1 is an exploded perspective view of a conventional golf club head.
Figure 2:
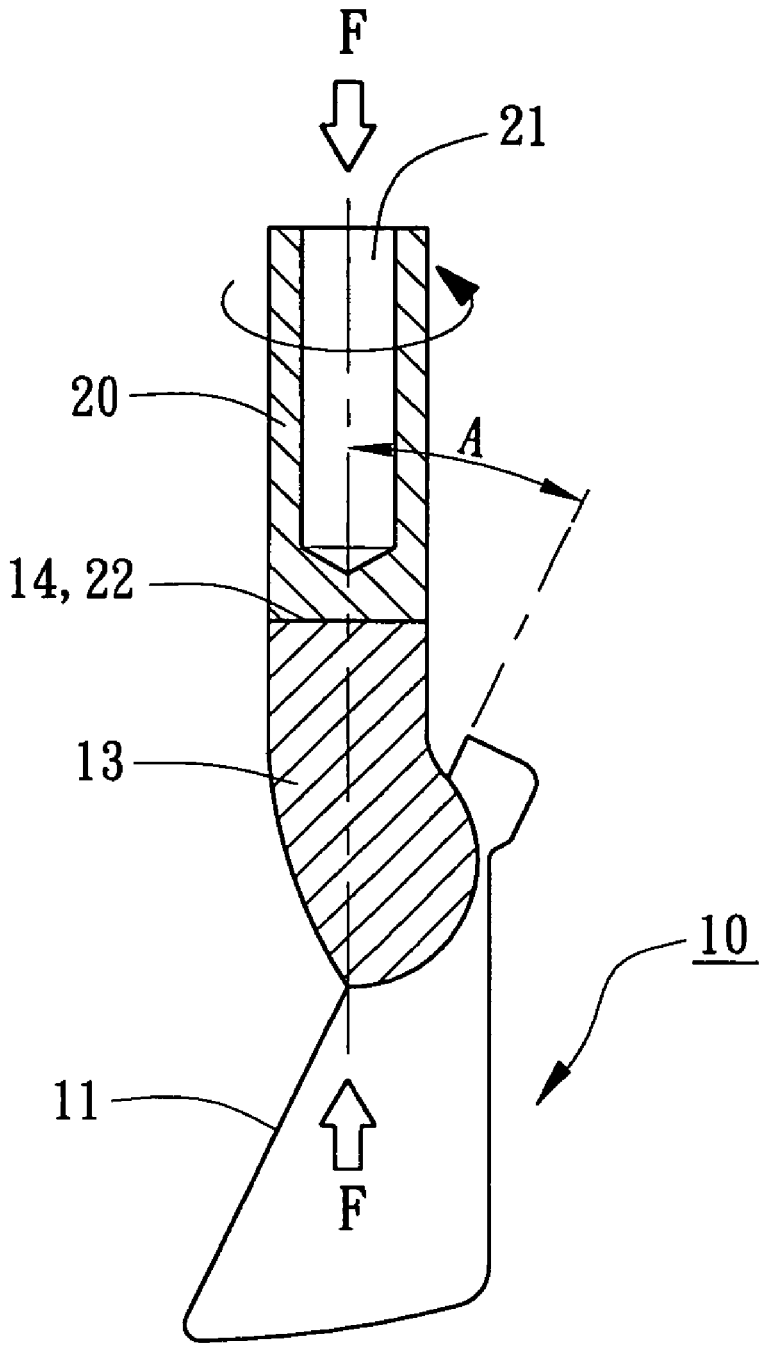
FIG. 2 PRIOR ART
FIG. 2 is a sectional view illustrating formation of the conventional golf club head by friction welding.
Figure 3:
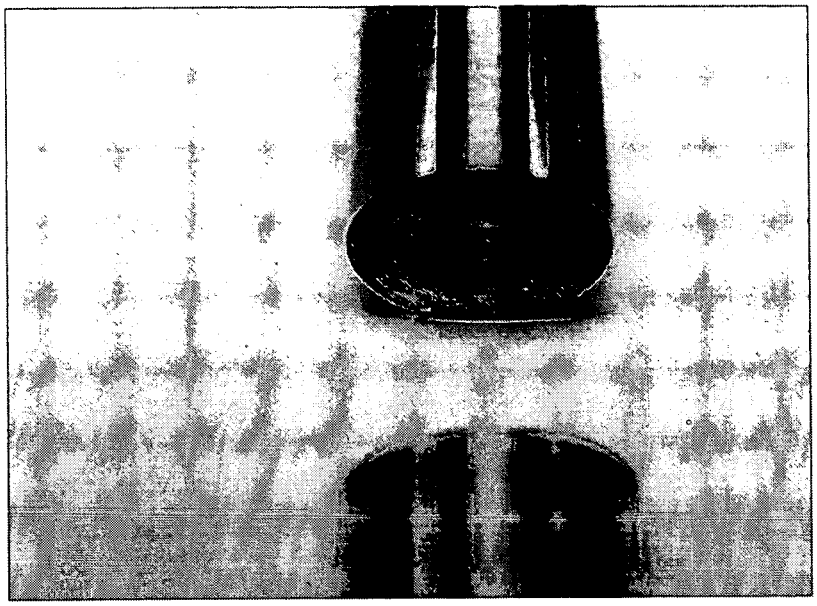
FIG. 3 PRIOR ART
FIG. 3 is a photograph showing two abutting portions respectively of two parts of a golf club head according to prior art.
Figure 4:
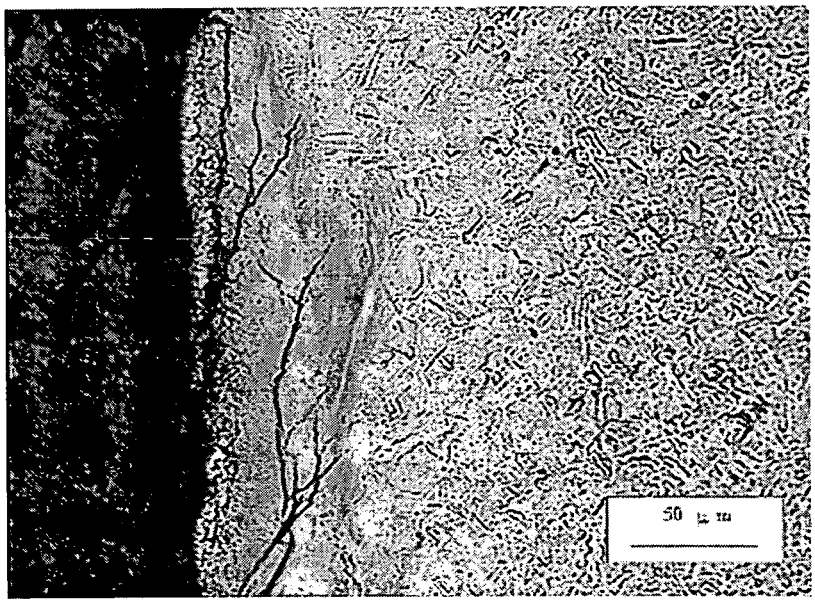
FIG. 4 PRIOR ART
FIG. 4 is a microphotograph showing crystalline phase of an intermetallic layer of a golf club head product manufactured by frictionally welding the parts of the golf club head in FIG. 3.

Preferred embodiments of the present invention are now to be described hereinafter in detail, in which the same reference numerals are used in the preferred embodiments for the same parts as those in the prior art to avoid redundant description.

Figure 5:
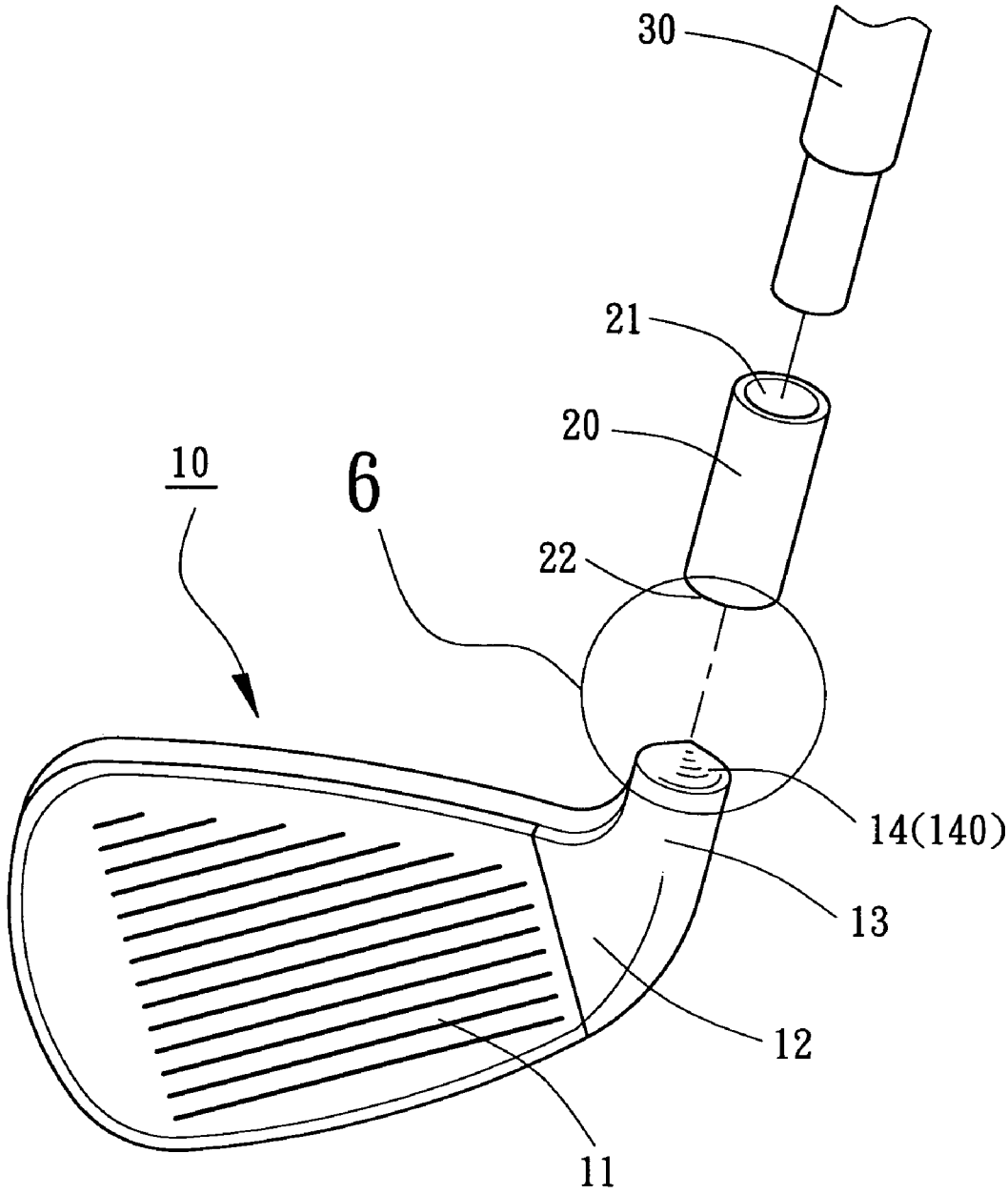
FIG. 5 is an exploded perspective view of a first embodiment of a golf club head in accordance with the present invention.

Referring to FIG. 5, a first embodiment of a golf club head in accordance with the present invention includes a first portion, a second portion, and at least one inclined or arcuate surface for friction welding 140. In this embodiment, the first portion is a head body 10 made of a first metal material. A striking plate 11 is formed on a front side of the head body 10 for striking a golf ball. A heel 12 is formed on a side of the striking plate 11, with an extension 13 extending upward from the heel 12 and having an abutting portion 14. Preferably, the abutting portion 14 is circular.

The second portion is a hosel 20 having an engaging hole 21 in an upper part thereof for engaging with a shaft 30. The hosel 20 further includes an abutting portion 22 formed at a lower part tbereof. The hosel 20 is made of a second metal material. Preferably, the abutting portion 22 is circular.

Figure 6:
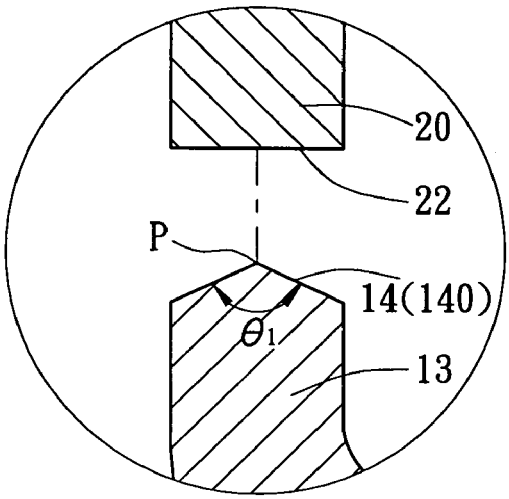
FIG. 6 is an enlarged view of a circled portion in FIG. 5.

The surface for friction welding 140 is a conic surface (i.e., inclined), as illustrated in FIGS. 5 and 6. In particular, the inclined surface for friction welding 140 is formed on the abutting portion 14 of the head body 10, with a central rotating axis of the inclined surface for friction welding 140 being coincident with that of the abutting portion 14 of the head body 10. Preferably, a cone-apex angle θ1 of the cone is between 90 degrees and 180 degrees. Given that the first metal material is different from the second metal material, each of the first metal material and the second metal material is selected from the group consisting of stainless steel, titanium alloy, carbon steel, low-alloy steel, cast iron, nickel-base alloy, structural steel, Fe—Mn—Al alloy, and super alloy. The shaft 30 can be made of other metal or non-metal material, such as carbon fiber composite material.

Figure 7:
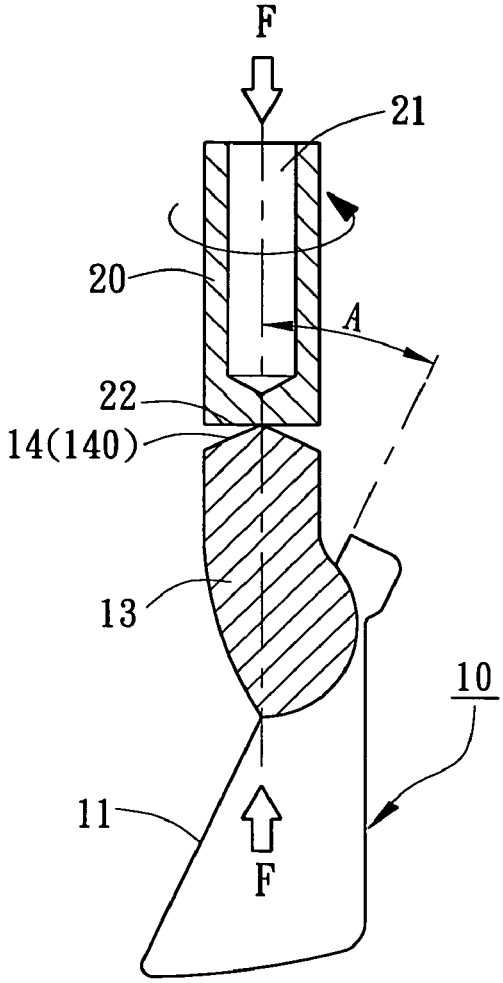
FIG. 7 is a sectional view illustrating formation of the golf club head in FIG. 5 by friction welding.
Figure 8:
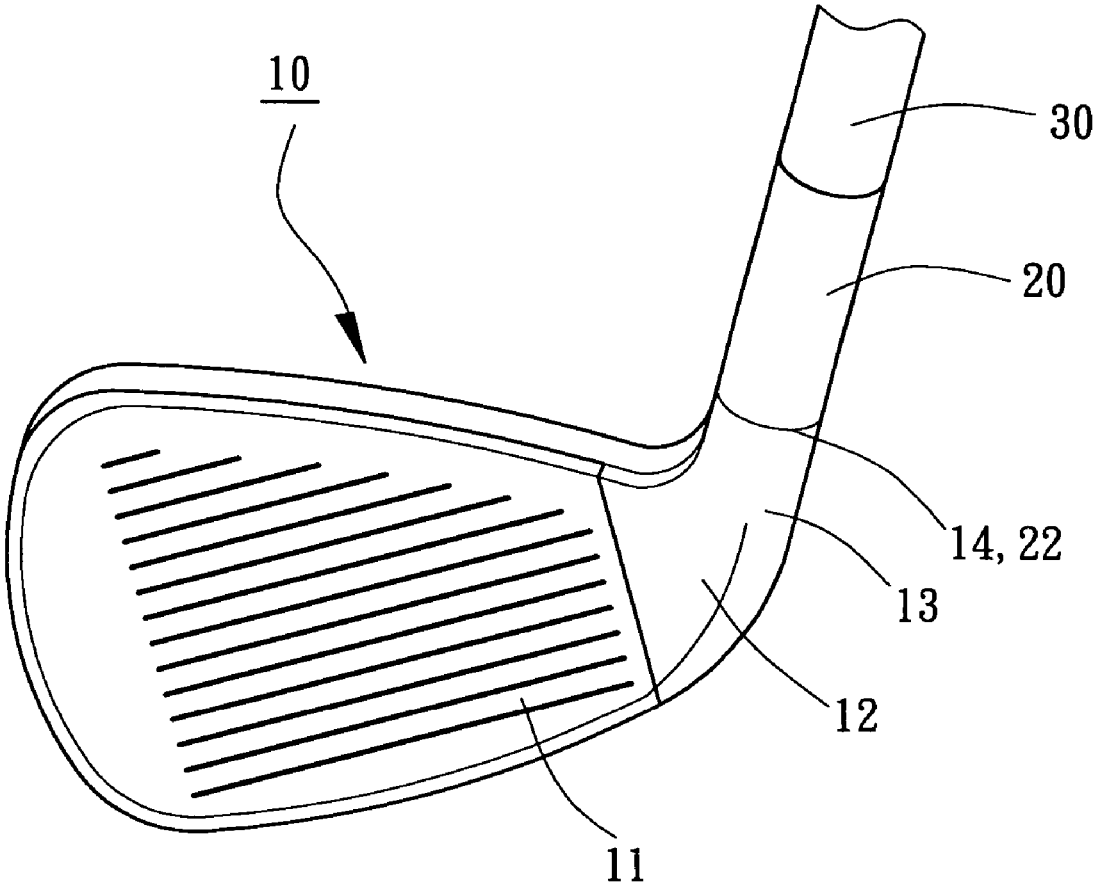
FIG. 8 is a perspective view of a golf club head product made from the golf club head in FIG. 5.

A method for manufacturing a golf club head by friction welding in accordance with the present invention will now be described. Referring to FIG. 7, an inclined surface (such as a conical surface in this embodiment) is formed on the abutting portion 14 of the head body 10 (the first portion). Next, the inclined surface 140 of the abutting portion 14 is pressed against the abutting portion 22 of the hosel 20 (the second portion). Then, the abutting portion 14 is turned relative to the abutting portion 22 about a central rotating axis, thereby proceeding with friction welding and thus forming a joining area (not labeled) between the abutting portion 14 and the abutting portion 22. The joining area between the abutting portion 14 and the abutting portion 22 are the subjected to surface finishing, forming a golf club head product, as shown in FIG. 8.

During the friction welding procedure, a force F is applied to the head body 10 and the hosel 20 to make the abutting portion 14 of the head body 10 and the abutting portion 22 of the hosel 20 abut against each other, with an apex P of the inclined surface for friction welding 140 abutting against a center of the abutting portion 22 of the hosel 20. Then, the abutting portion 14 (or the abutting portion 22) is turned relative to the abutting portion 22 (or the abutting portion 14). With the friction heat, the abutting portion 14 is joined to the abutting portion 22. Thus, the hosel 20 is rapidly joined to the head body 10. A golf club head product is obtained after subsequent surface finishing and removal of residuals.

Figure 9:
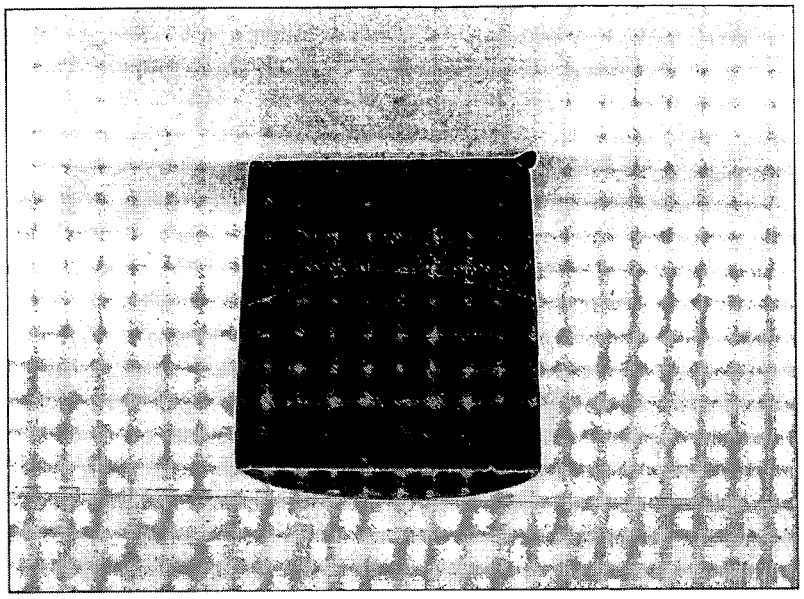
FIG. 9 is a photograph showing a joining area of two abutting portions respectively of two parts of a golf club head in FIG. 5.
Figure 10:
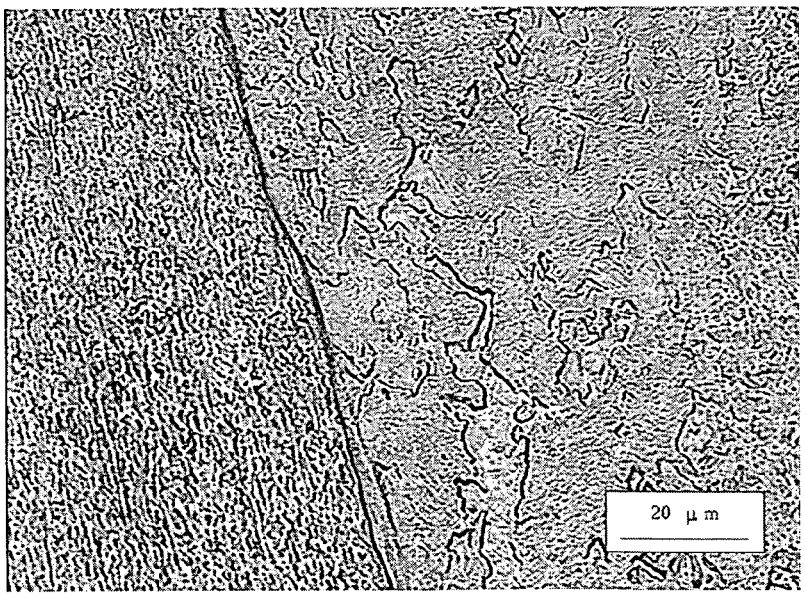
FIG. 10 a microphotograph showing crystalline phase of the joining area of a golf club head product manufactured by frictionally welding the parts of the golf club head in FIG. 5.

Referring to FIGS. 9 and 10, since the apex P of the inclined surface for friction welding 140 abuts against a center of the abutting portion 22 of the hosel 20, a relatively small contact area exists between the abutting portion 14 and the abutting portion 22 in the beginning of the friction welding. An advantage of this arrangement is that the force F may create a relatively large pressure on the relatively small contact area, thereby providing a relatively high temperature for friction welding. This avoids generation of an intermetallic layer between the butting portion 14 and the abutting portion 22 and increases the overall joining area. As a result, the head body 10 made of a first metal material and the hosel 20 made of a second metal material can be reliably bonded by friction welding.

Table 1 shows the results of tensile tests on golf club head products (samples 1 and 2), on golf club head products (samples 3 through 7) manufactured by the method in accordance with the present invention, and on a gold club head product (sample 8) made of carbon steel of S20C. The head body is made of stainless steel, and the hosel is made of titanium alloy. The golf club head products manufactured by the method in accordance with the present invention are obtained an improvement of tension strength via appropriate control of the radius of curvature of the joining area of friction welding (see FIG. 9). For example, the striking plate 11 of the head body 10 are shot three thousands (3000) times with a golf ball with a standard weight and a velocity of 50 m/sec. The results show that the head body 10 and the hosel 20 manufactured by the method in accordance with the present invention were less likely to crack, break, or disengage from each other. The bonding strength and bonding reliability of the golf club head products manufactured by the method in accordance with the present invention are improved by the inclined face for friction welding 140. Further, subsequent adjustment of the inclination angle A of the hosel 20 is convenient, and the life of the golf club head product is prolonged.

TABLE 1

| Samp. | Diameter of joining surface | Joining area condition | Tensile strength ($kg/mm^2$) | Result of tensile test |
|---|---|---|---|---|
| 1 | 13.11 mm | planar | 16.85 | Breakage occurs easily |
| 2 | 13.09 mm | planar | 14.18 | Breakage occurs easily |
| 3 | 13.06 mm | radius of curvature 50 mm | 24.81 | Breakage occurs somewhat easily |
| 4 | 13.09 mm | radius of curvature 30 mm | 38.51 | Breakage occurs somewhat easily |
| 5 | 12.80 mm | radius of curvature 20 mm | 48.20 | No breakage |
| 6 | 12.95 mm | radius of curvature 20 mm | 45.57 | No breakage |
| 7 | 6.09 | radius of curvature 20 mm | 54.44 | Breakage occurs somewhat easily |
| 8 | carbon steel of S20C | without friction welding | 56.34 | breakage |

The surface roughnesses of the abutting portion 14 and the abutting portion 22 are smaller than Ra 25 μm. By this arrangement, when the abutting portion 14 and the abutting portion 22 abut against each other, the oxidized layer (not shown) on the contacting area is scraped by the surface roughness in the beginning of the friction welding procedure. Thus, adverse affection to the bonding strength and bonding reliability by the oxidized layer is avoided.

Figure 11:
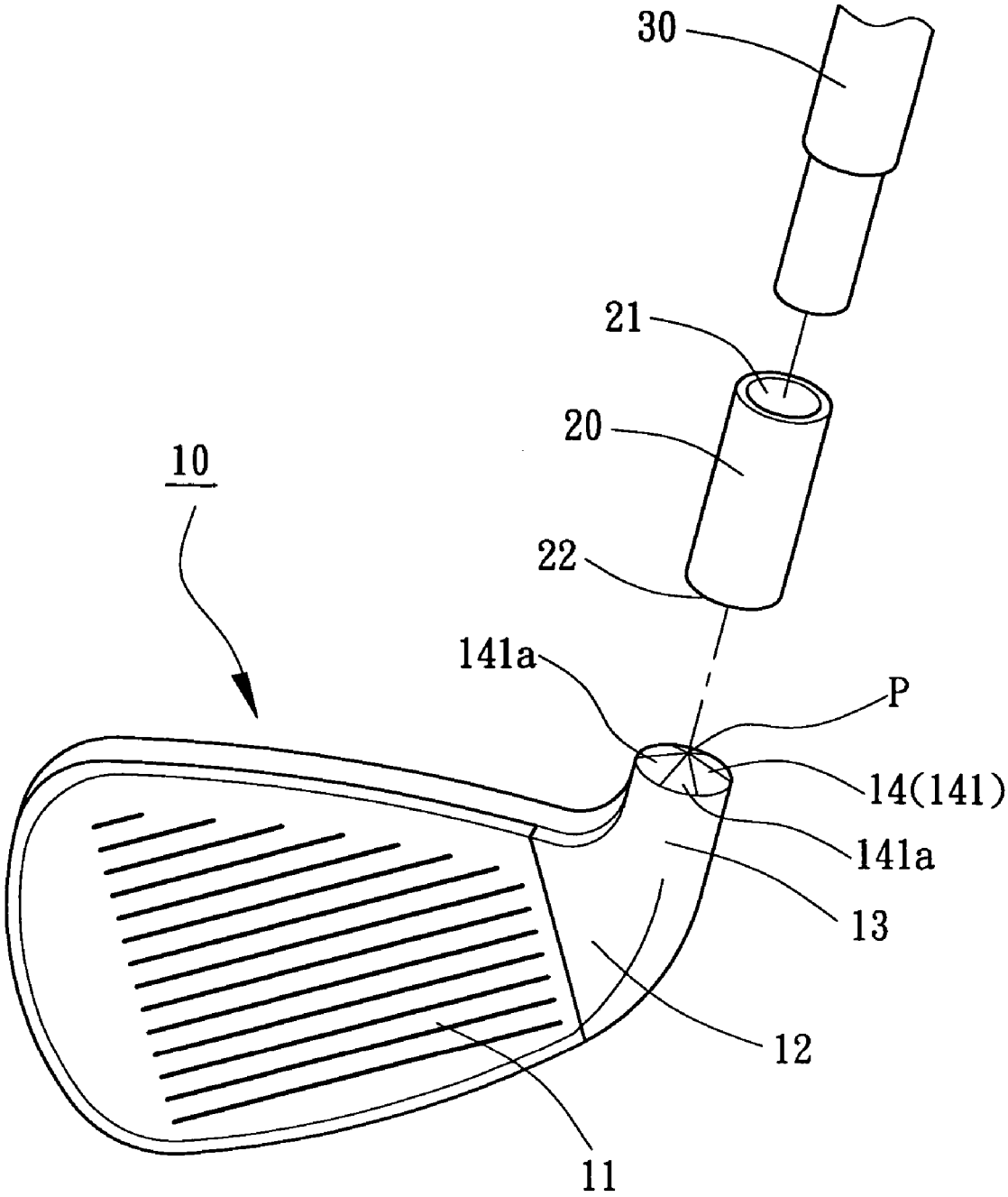
FIG. 11 is an exploded perspective view of a second embodiment of the golf club head in accordance with the present invention.

FIG. 11 illustrates a second embodiment of the present invention, wherein the inclined surface for friction welding (now designated by 141) of the head body 10 (the first portion) includes a plurality of angularly arranged triangular inclined sections 141*a* having a common apex P. Similar to the first embodiment, the inclined surface for friction welding 141 increases the abutting pressure, increases the temperature for friction welding, provides improved bonding by friction welding, avoids generation of the intermetallic layer, increases the joining area, improves the bonding strength, and improves the bonding reliability.

Figure 12:
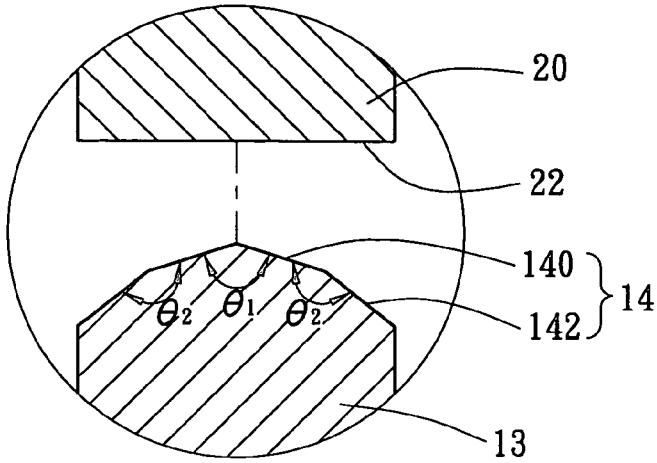
FIG. 12 is a view similar to FIG. 6, illustrating a third embodiment of the golf club head in accordance with the present invention.

FIG. 12 illustrates a third embodiment of the present invention, wherein the abutting portion 14 of the head body 10 (the first portion) includes a first inclined surface section 140 and a second inclined surface section 142 surrounding the first inclined surface section 140. The first inclined surface section 140 is a conic face having an a cone-apex angle θ1, and the second inclined surface section 142 is an annular face at an angle θ2 with the first inclined surface section 140. Preferably, the cone-apex angle θ1 is between 90 degrees and 180 degrees. Preferably, the angle θ2 is between 120 degrees and 180 degrees. The first and second inclined surface sections 140 and 142 increase the abutting pressure, increase the temperature for friction welding, provide improved bonding by friction welding, avoid generation of the intermetallic layer, increase the joining area, improve the bonding strength, and improve the bonding reliability. Further, the first inclined surface section 140 may include a plurality of annularly arranged triangular inclined sections having a common apex (see FIG. 11), and the second inclined surface section 142 may include a plurality of annularly arranged trapezoidal inclined sections.

Figure 13:
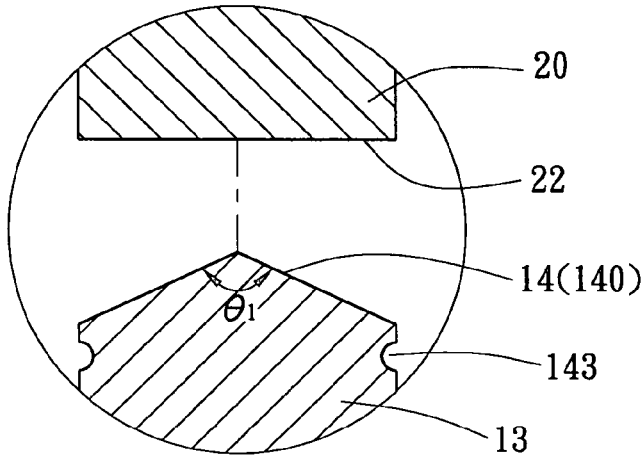
FIG. 13 is a view similar to FIG. 6, illustrating a fourth embodiment of the golf club head in accordance with the present invention.

FIG. 13 illustrates a fourth embodiment of the present invention that is modified from the first embodiment of FIG. 6. In this embodiment, an annular groove 143 is defined in an outer periphery of the extension 13 and located adjacent to a circumference of the abutting portion 14 for friction welding. The annular groove 143 provides the outer periphery of the abutting portion 14 with improved deformability during friction welding. Thus, the abutting portion 14 deforms appropriately when the friction welding is proceeded at an area adjacent to the circumference of the abutting portion 14. As a result, solid bonding occurs in the circumference of the abutting portion 14 due to high friction heat. The bonding reliability in the circumference of the abutting portion 14 is improved.

Figure 14:
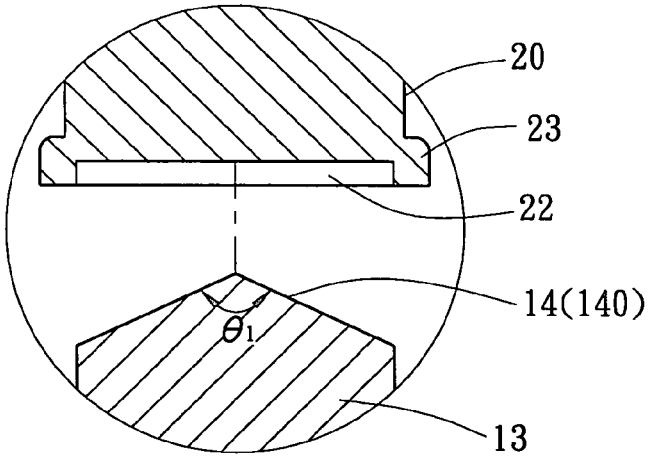
FIG. 14 is a view similar to FIG. 6, illustrating a fifth embodiment of the golf club head in accordance with the present invention.

FIG. 14 illustrates a fifth embodiment of the present invention that is modified from the first embodiment of FIG. 6. In this embodiment, the abutting portion 22 of the hosel 20 (the second portion) includes an annular wall 23 delimiting a space (not labeled) for guiding and receiving the abutting portion 14 of the club head 10 (the first portion). The annular wall 23 allows precise alignment between the head body 10 and the hosel 20. After friction welding, the annular wall 23 can be kept or removed by proper surface finishing, providing a golf club head product (see FIG. 8).

Figure 15:
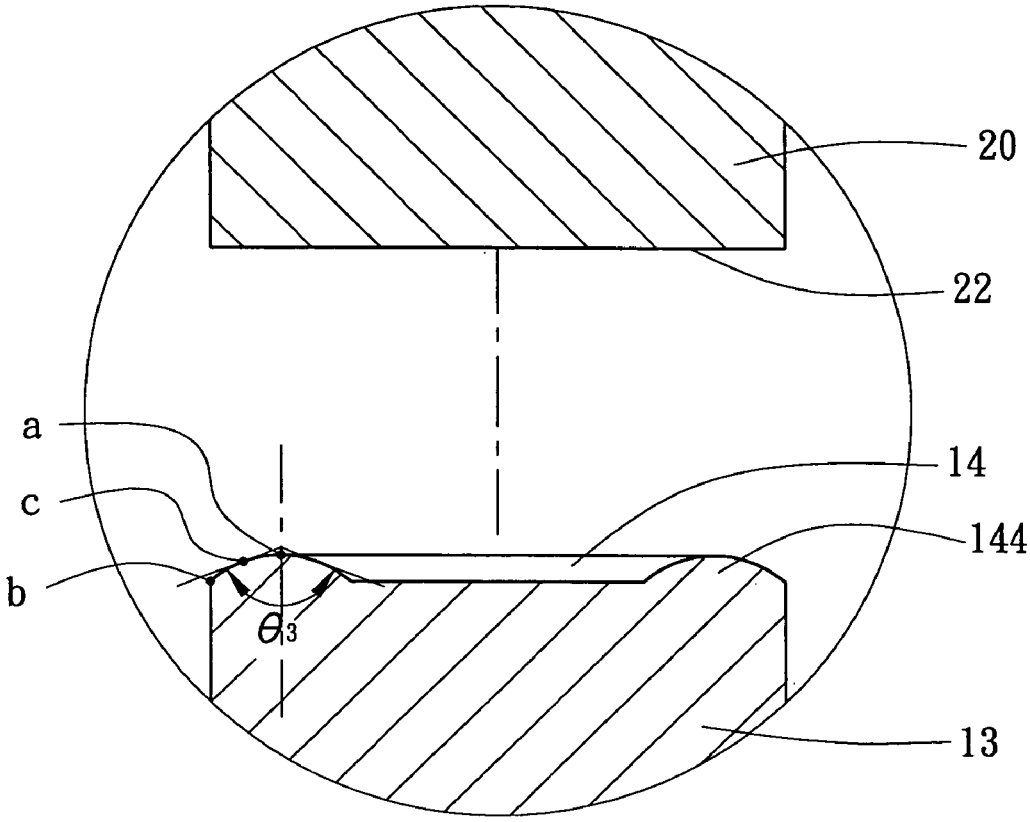
FIG. 15 is a view similar to FIG. 6, illustrating a sixth embodiment of the golf club head in accordance with the present invention.

FIG. 15 illustrates a sixth embodiment of the present invention. In this embodiment, the surface for friction welding is arcuate. In particular, the abutting portion 14 of the head body 10 (the first portion) includes an annular bulge 144 on a circumference thereof. The annular bulge 144, when viewed in section, is arc-shaped, semi-circular, or semi-elliptic. More specifically, given that "a" represents an apex of a section of the annular bulge 141, "b" represents two end points of the annular bulge 141 in the section, and "c" is the middle point between the apex "a" and the respective end points "b", an angle θ3 between two tangent lines respectively passing through the middle points "c" is between 90 degrees and 180 degrees. In brief, the arc of the annular bulge 144 has an angle between 90 degrees and 180 degrees when viewed in section.

The annular bulge 144 increases the abutting pressure, increases the temperature for friction welding, provides improved bonding by friction welding, avoids generation of the intermetallic layer, increases the joining area, improves the bonding strength, and improves the bonding reliability.

Figure 16:
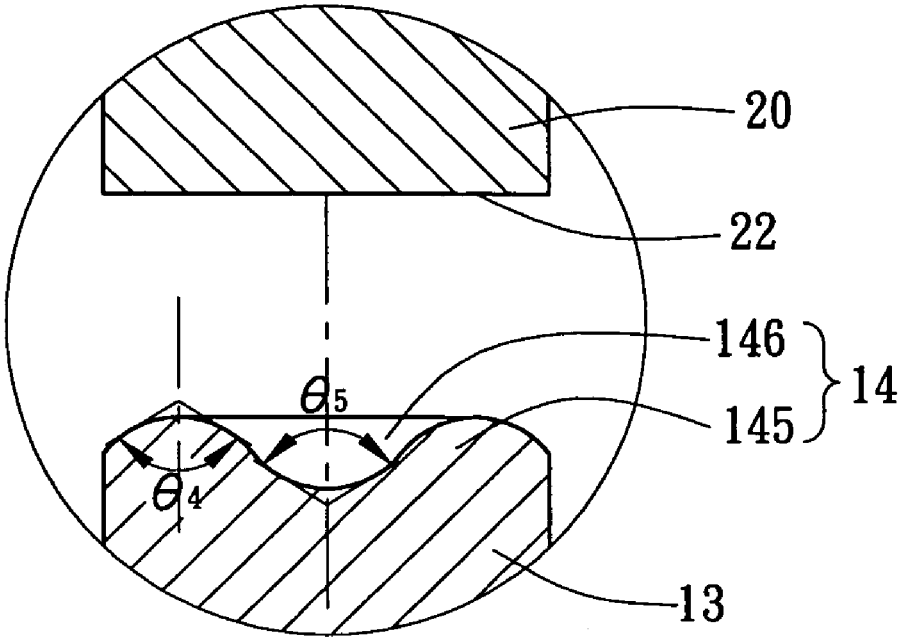
FIG. 16 is a view similar to FIG. 6, illustrating a seventh embodiment of the golf club head in accordance with the present invention.

FIG. 16 illustrates a seventh embodiment of the present invention. In this embodiment, the surface for friction welding is arcuate. In particular, the abutting portion 14 of the head body 10 (the first portion) includes an annular bulge 145 on a circumference thereof. Further, the abutting portion 14 includes a central groove 146 in a central portion thereof and surrounded by the annular bulge 145. The annular bulge 145, when viewed in section, is arc-shaped, semi-circular, or semi-elliptic. The arc of the annular bulge 145 has an angle θ4 ranging between 90 degrees and 180 degrees. Further, the central groove 146 when viewed in section, is arc-shaped, semi-circular, or semi-elliptic. The arc of the central groove 146 has an angle θ5 ranging between 90 degrees and 180 degrees. The angles θ4 and θ5 are obtained in a manner similar to that for the angle θ3.

The annular bulge 145 and the central groove 146 increase the abutting pressure, increase the temperature for friction welding, provide improved bonding by friction welding, avoid generation of the intermetallic layer, increase the joining area, improve the bonding strength, and improve the bonding reliability.

Figure 17:
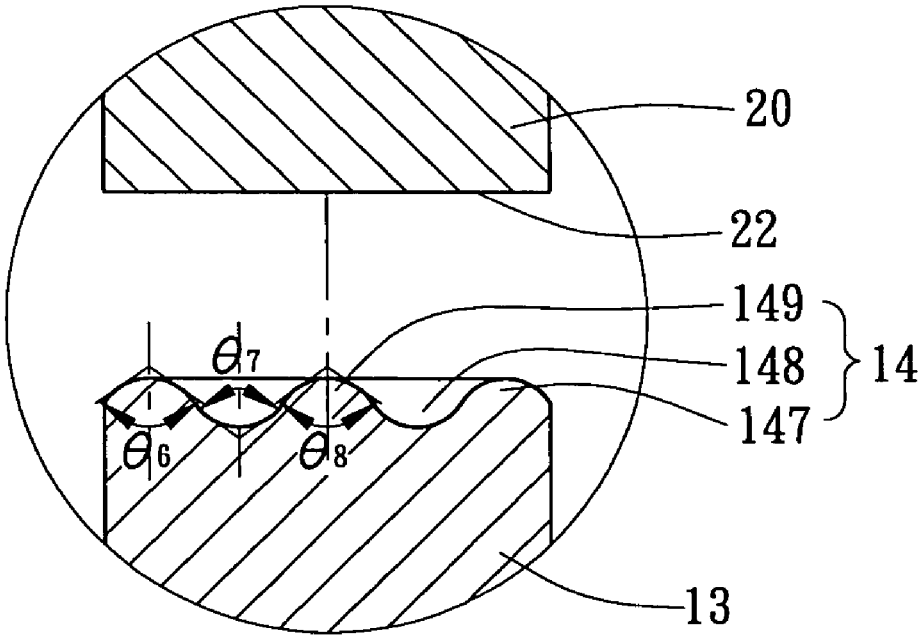
FIG. 17 is a view similar to FIG. 6, illustrating an eighth embodiment of the golf club head in accordance with the present invention.

FIG. 17 illustrates an eighth embodiment of the present invention. In this embodiment, the surface for friction welding is arcuate. In particular, the abutting portion 14 of the head body 10 (the first portion) includes an annular bulge 147 on a circumference thereof. Further, the abutting portion 14 includes a central bulge 149 on a central portion thereof and an annular groove 148 between the annular bulge 147 and the central bulge 149. The annular bulge 147, the annular groove 148, and the central bulge 149, when viewed in section, are arc-shaped, semi-circular, or semi-elliptic. The arc of the annular bulge 147 has an angle θ6 ranging between 90 degrees and 180 degrees. The arc of the annular groove 148 has an angle θ7 ranging between 90 degrees and 180 degrees. The arc of the central bulge 149 has an angle θ8 ranging between 90 degrees and 180 degrees. The angles θ6, θ7, and θ8 are obtained in a manner similar to the angle θ3.

The annular bulge 147, the annular groove 148, and the central groove is 149 increase the abutting pressure, increase the temperature for friction welding, provide improved bonding by friction welding, avoid generation of the intermetallic layer, increase the joining area, improve the bonding strength, and improve the bonding reliability.

FIGS. 18 through 21 illustrate a ninth embodiment of the present invention. In this embodiment, the gold club head includes a first portion, a second portion, and at least one inclined surface for friction welding 160. The first portion is a head body 10 made of a first metal material. The head body 10 includes a compartment 15 in an appropriate portion thereof (such as the bottom side of the head body 10). A bottom wall delimiting the compartment 15 forms an abutting portion 16. The second portion is a weight member 40 (made of a second metal material) includes an abutting portion 41 on a side thereof.

Figure 18:
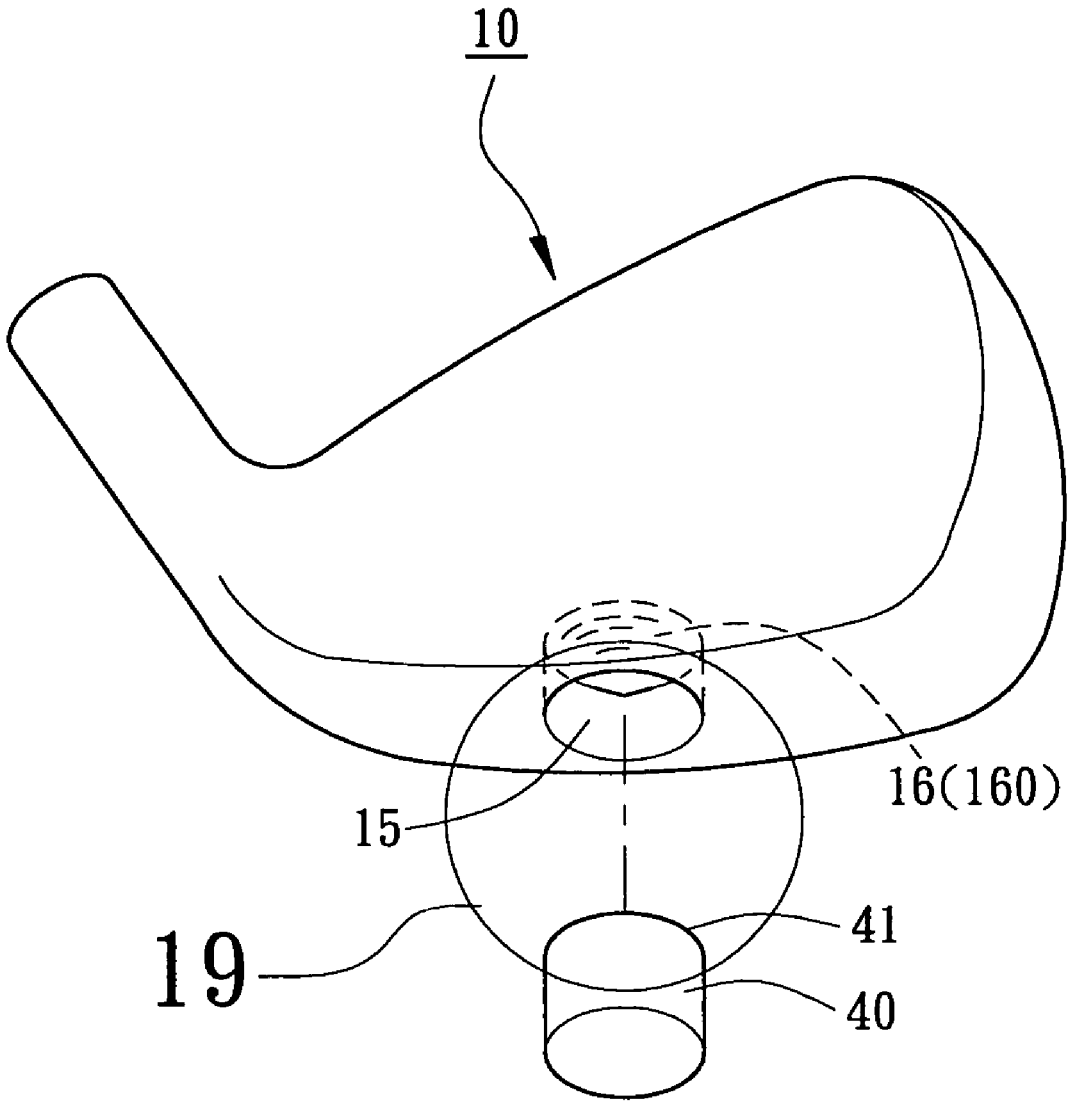
FIG. 18 is an exploded perspective view of a ninth embodiment of the golf club head in accordance with the present invention.
Figure 19:
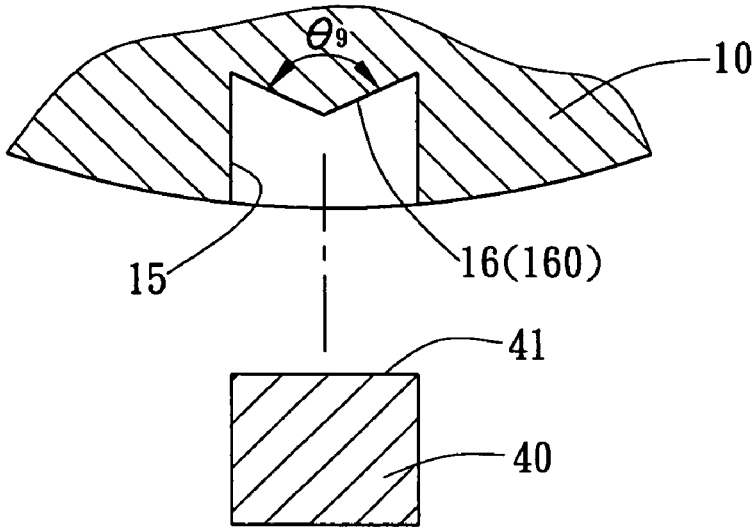
FIG. 19 is an enlarged view of a circled portion in FIG. 18.
Figure 20:
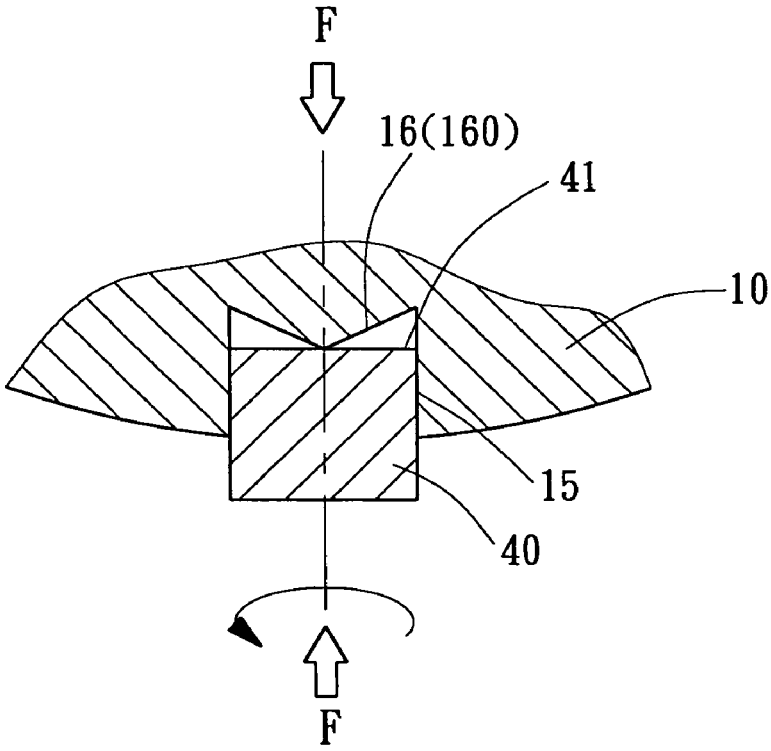
FIG. 20 is a sectional view similar to FIG. 19, illustrating formation of the golf club head in FIG. 18 by friction welding.
Figure 21:
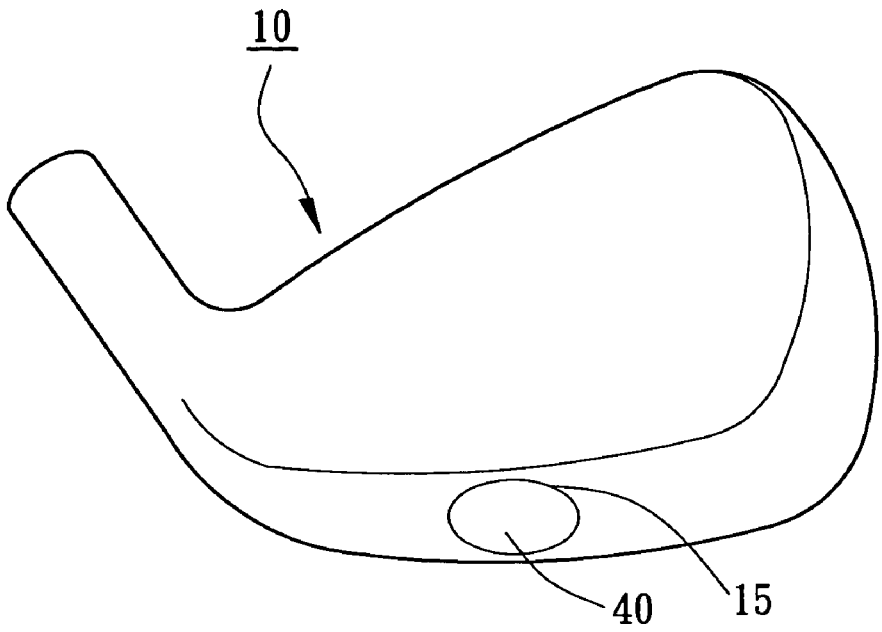
FIG. 21 is a perspective view of a golf club head product made from the golf club head in FIG. 18.

The inclined surface for friction welding 160 is formed on the abutting portion that is more rigid. Namely, the inclined surface for friction welding 160 is formed on the abutting portion 16 of the head body 16 (or the abutting portion 41 of the weight member 40), with a central rotating axis of the inclined surface for friction welding 160 being coincident with that of the abutting portion 16 (or the abutting portion 41). The inclined surface for friction welding 160 is conic, as illustrated in FIGS. 18 and 19. Preferably, a cone-apex angle θ9 of the cone is between 90 degrees and 180 degrees. The inclined surface for friction welding 160 may include a plurality of annularly arranged triangular inclined sections having a common apex (see FIG. 11).

The head body 10 and the weight member 40 are joined together by friction welding under the condition of applying a force F to the head body 10 and the weight member 40. A golf club head product (see FIG. 21) is obtained after removal of residuals on the weight member 40. In this embodiment, the first metal material (for the head body 10) is selected from the group consisting of stainless steel, carbon steel, titanium alloy, low-alloy steel, cast iron, nickel-base alloy, structural steel, Fe—Mn—Al alloy, and super alloy. The second metal material (for the weight member 40) is selected from the group consisting of W—Fe—Ni alloy, tungsten alloy, molybdenum (Mo) alloy, and copper alloy. Alternatively, the second metal material is a metal or alloy having a specific density greater than 7.6 $g/cm^3$.

Figure 22:
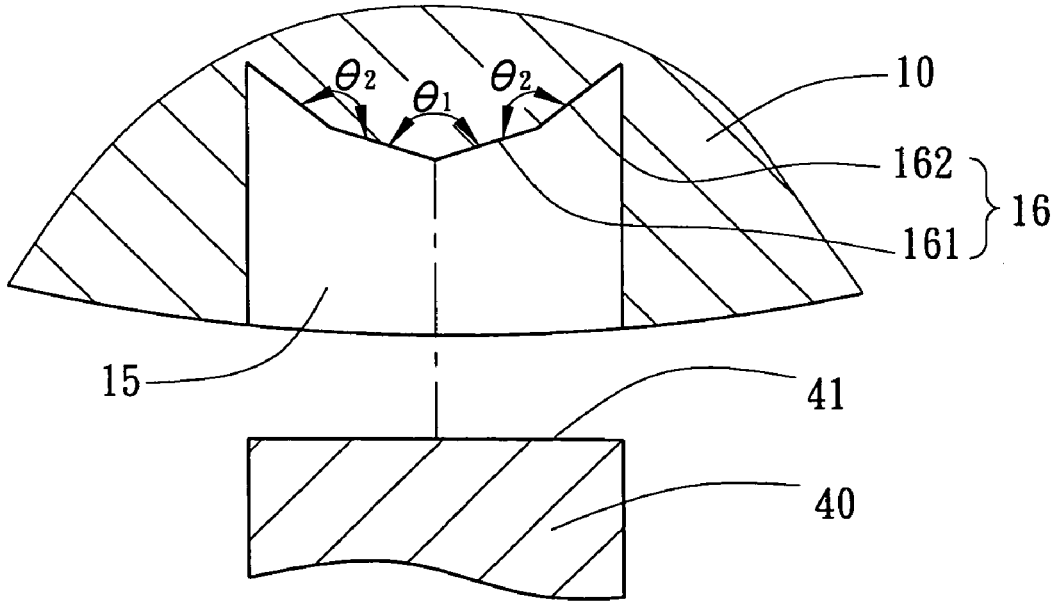
FIG. 22 is a sectional view similar to FIG. 19, illustrating a tenth embodiment of the present invention.

FIG. 22 illustrates a tenth embodiment of the present invention modified from the embodiment of FIG. 19, wherein the abutting portion 16 of the head body 10 (the first portion) includes a first inclined surface section 161 and a second inclined surface section 162 surrounding the first inclined surface section 161. The first inclined surface section 161 is a conic face having an a cone-apex angle θ1, and the second inclined surface section 162 is an annular face at an angle θ2 with the first inclined surface section 161. Preferably, the cone-apex angle θ1 is between 90 degrees and 180 degrees. Preferably, the angle θ2 is between 120 degrees and 180 degrees. The first and second inclined surface sections 161 and 162 increase the abutting pressure, increase the temperature for friction welding, provide improved bonding by friction welding, avoid generation of the intermetallic layer, increase the joining area, improve the bonding strength, and improve the bonding reliability. Further, the first inclined surface section 160 may include a plurality of annularly arranged triangular inclined sections having a common apex, and the second inclined surface section 162 may include a plurality of annularly arranged trapezoidal inclined sections.

Figure 23:
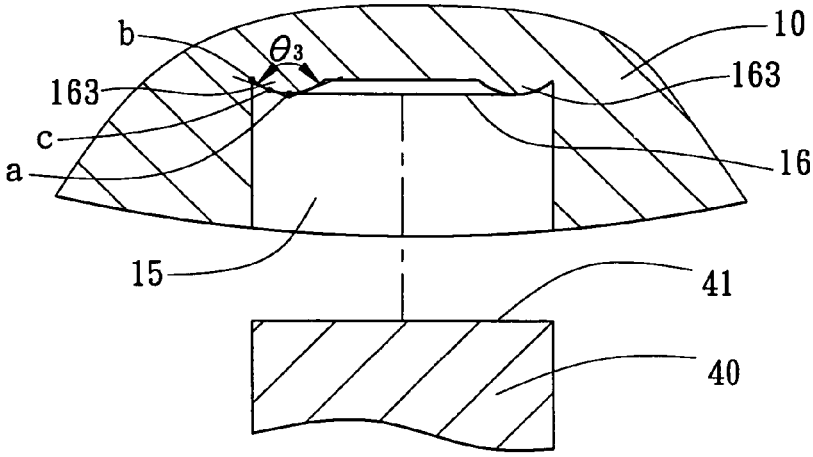
FIG. 23 is an exploded sectional view similar to FIG. 19, illustrating an eleventh embodiment of the present invention.

FIG. 23 illustrates an eleventh embodiment of the present invention. In this embodiment, the surface for friction welding is arcuate. In particular, the abutting portion 16 of the head body 10 (the first portion) includes an annular bulge 163 on a circumference thereof. The annular bulge 163, when viewed in section, is arc-shaped, semi-circular, or semi-elliptic. The arc of the annular bulge 163 has an angle between 90 degrees and 180 degrees. The angle θ3 of this embodiment is obtained in a manner similar to that for the angle θ3 in FIG. 15.

The annular bulge 163 increases the abutting pressure, increases the temperature for friction welding, provides improved bonding by friction welding, avoids generation of the intermetallic layer, increases the joining area, improves the bonding strength, and improves the bonding reliability.

Figure 24:
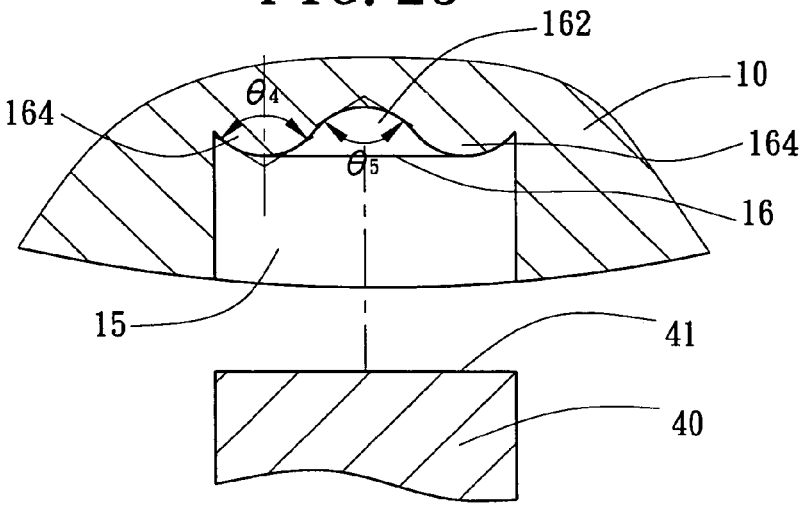
FIG. 24 is an exploded sectional view similar to FIG. 19, illustrating a twelfth embodiment of the present invention.

FIG. 24 illustrates a twelfth embodiment of the present invention. In this embodiment, the surface for friction welding is arcuate. In particular, the abutting portion 16 of the head body 10 (the first portion) includes an annular bulge 164 on a circumference thereof. Further, the abutting portion 16 includes a central groove 162 in a central portion thereof and surrounded by the annular bulge 164. The annular bulge 164, when viewed in section, is arc-shaped, semi-circular, or semi-elliptic. The arc of the annular bulge 164 has an angle θ4 ranging between 90 degrees and 180 degrees. Further, the central groove 162 when viewed in section, is arc-shaped, semi-circular, or semi-elliptic. The arc of the central groove 162 has an angle θ5 ranging between 90 degrees and 180 degrees. The angles θ4 and θ5 of this embodiment are obtained in a manner similar to that for the angle θ3 in FIG. 15.

The annular bulge 164 and the central groove 162 increase the abutting pressure, increase the temperature for friction welding, provide improved bonding by friction welding, avoid generation of the intermetallic layer, increase the joining area, improve the bonding strength, and improve the bonding reliability.

Figure 25:
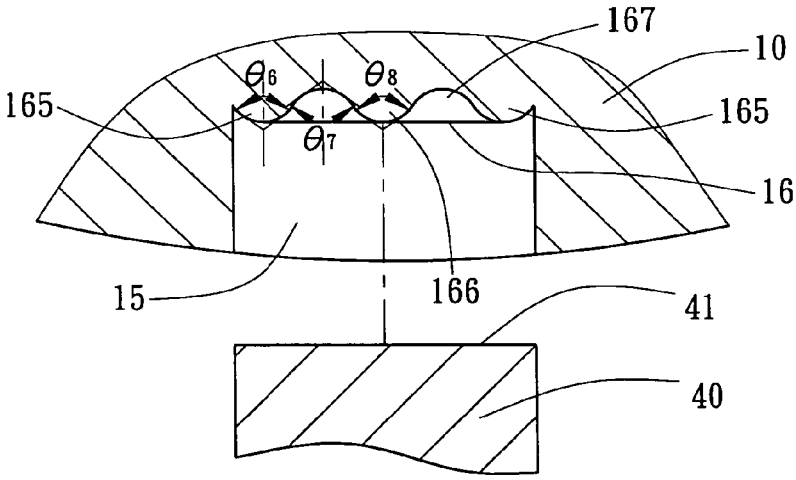
FIG. 25 is an exploded sectional view similar to FIG. 19, illustrating a thirteenth embodiment of the present invention.

FIG. 25 illustrates a thirteenth embodiment of the present invention. In this embodiment, the surface for friction welding is arcuate. In particular, the abutting portion 16 of the head body 10 (the first portion) includes an annular bulge 165 on a circumference thereof. Further, the abutting portion 16 includes a central bulge 166 on a central portion thereof and an annular groove 167 between the annular bulge 165 and the central bulge 166. The annular bulge 165, the annular groove 167, and the central bulge 166, when viewed in section, are arc-shaped, semi-circular, or semi-elliptic. The arc of the annular bulge 165 has an angle θ6 ranging between 90 degrees and 180 degrees. The arc of the annular groove 167 has an angle θ7 ranging between 90 degrees and 180 degrees. The arc of the central bulge 166 has an angle θ8 ranging between 90 degrees and 180 degrees. The angles θ6, θ7, and θ8 of this embodiment are obtained in a manner similar to that for the angle θ3 in FIG. 15.

The annular bulge 165, the annular groove 167, and the central groove 166 increase the abutting pressure, increase the temperature for friction welding, provide improved bonding by friction welding, avoid generation of the intermetallic layer, increase the joining area, improve the bonding strength, and improve the bonding reliability.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A method for manufacturing a golf club head by friction welding, comprising:

forming one of at least one inclined surface and at least one arcuate surface on an abutting portion of a first portion of a head body of the golf club head in aiding friction welding, said at least one inclined surface including a conic first inclined surface section and a second inclined surface section surrounding the conic first inclined surface section and at an angle with respect to the conic first inclined surface section, said conic first inclined surface section including a plurality of annularly arranged triangular inclined sections having a common apex;

abutting the abutting portion of the first portion against an abutting portion of a second portion of the head body of the golf club head in preparing friction welding; and rotating one of the abutting portion of the first portion and the abutting portion of the second portion relative to the other of the abutting portion of the first portion and the abutting portion of the second portion about an axis to proceed with friction welding thereby forming a joining area; and surface finishing the joining area of the abutting portion of the first portion and the abutting portion of the second portion.

2. A method for manufacturing a golf club head by friction welding, comprising:

forming one of at least one inclined surface and at least one arcuate surface on an abutting portion of a first portion of a head body of the golf club head in aiding friction welding, said at least one inclined surface including a conic first inclined surface section and a second inclined surface section surrounding the conic first inclined surface section and at an angle with respect to the conic first inclined surface section;

abutting the abutting portion of the first portion against an abutting portion of a second portion of the head body of the golf club head in preparing friction welding; and rotating one of the abutting portion of the first portion and the abutting portion of the second portion relative to the other of the abutting portion of the first portion and the abutting portion of the second portion about an axis to proceed with friction welding thereby forming a joining area; and surface finishing the joining area of the abutting portion of the first portion and the abutting portion of the second portion;

wherein the second inclined surface section includes a plurality of annularly arranged trapezoidal inclined sections.

3. The method as claimed in claim 2, wherein the abutting portion of the first portion is formed on an extension extending from a heel of the head body, and wherein the abutting portion of the second portion is formed on a hosel.

4. The method as claimed in claim 2, wherein the conic first inclined surface section includes a plurality of annularly arranged triangular inclined sections having a common apex.

* * * * *